US007727411B2

(12) United States Patent
Yamamuro et al.

(10) Patent No.: US 7,727,411 B2
(45) Date of Patent: Jun. 1, 2010

(54) MANUFACTURING METHOD OF SUBSTRATE FOR INK JET HEAD AND MANUFACTURING METHOD OF INK JET RECORDING HEAD

(75) Inventors: Jun Yamamuro, Yokohama (JP); Shuji Koyama, Kawasaki (JP); Kenji Ono, Tokyo (JP); Toshiyasu Sakai, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 423 days.

(21) Appl. No.: 11/681,411

(22) Filed: Mar. 2, 2007

(65) Prior Publication Data

US 2007/0212891 A1 Sep. 13, 2007

(30) Foreign Application Priority Data

Mar. 7, 2006 (JP) ..... 2006-061403

(51) Int. Cl.
*B41J 2/16* (2006.01)

(52) U.S. Cl. ..... 216/27; 216/17; 216/94; 216/96; 438/21; 438/706; 438/719; 438/745; 438/753; 29/890.1; 219/121.6; 219/121.69

(58) Field of Classification Search ..... 438/706, 438/719, 745, 753, 21; 216/17, 27, 94, 96; 347/20, 65; 29/890.1; 219/121.6, 121.69
See application file for complete search history.

(56) References Cited

U.S. PATENT DOCUMENTS

| | | | | |
|---|---|---|---|---|
| 5,760,803 | A | 6/1998 | Yamamoto et al. | 347/47 |
| 6,022,751 | A * | 2/2000 | Shindo et al. | 438/21 |
| 6,107,209 | A | 8/2000 | Ohkuma | 438/733 |
| 6,143,190 | A * | 11/2000 | Yagi et al. | 216/27 |
| 6,397,466 | B1 | 6/2002 | Koyama et al. | 29/890.1 |
| 6,422,686 | B1 | 7/2002 | Ishinaga et al. | 347/47 |
| 6,805,432 | B1 * | 10/2004 | Milligan et al. | 347/65 |
| 2004/0070643 | A1 * | 4/2004 | Kubota et al. | 347/20 |
| 2004/0238485 | A1 * | 12/2004 | Hayakawa et al. | 216/27 |
| 2005/0179744 | A1 * | 8/2005 | Sasaki | 347/65 |
| 2006/0061626 | A1 | 3/2006 | Saito et al. | 347/58 |
| 2006/0191862 | A1 * | 8/2006 | Hayakawa et al. | 216/27 |
| 2007/0212890 | A1 | 9/2007 | Sakai et al. | 438/733 |

* cited by examiner

*Primary Examiner*—Shamim Ahmed
(74) *Attorney, Agent, or Firm*—Fitzpatrick, Cella, Harper & Scinto

(57) ABSTRACT

The present invention provides a manufacturing method of a substrate for an ink jet head including forming an ink supply opening to a silicon substrate, including (a) forming, at the back surface of the silicon substrate, an etching mask layer, which has an opening that is asymmetric with a center line, extending in the longitudinal direction, of an area on the surface of the silicon substrate where the ink supply opening is to be formed; (b) forming a non-through hole on the silicon substrate via the opening on the etching mask layer; and (c) forming the ink supply opening by performing a crystal anisotropic etching to the silicon substrate from the opening.

11 Claims, 6 Drawing Sheets

MANUFACTURING METHOD OF SUBSTRATE FOR INK JET HEAD AND MANUFACTURING METHOD OF INK JET RECORDING HEAD

BACKGROUND OF THE INVENTION

1. Field of the Invention

The present invention relates to a manufacturing method of a substrate for an ink jet head that discharges ink for performing recording onto a recording medium in accordance with an ink jet system, and a manufacturing method of an ink jet head.

2. Related Background Art

There has conventionally been known an ink jet head (hereinafter referred to as "side shooter type head") that discharges ink to the portion above an ink discharge pressure generating element. In this type of ink jet head, a through hole (ink supply opening) is formed on a substrate having a discharge energy generating section formed thereto, wherein ink is supplied from the back surface opposite to the surface on which the discharge energy generating section is provided.

U.S. Pat. No. 6,143,190 discloses a manufacturing method of this type of ink jet head. It discloses the manufacturing method including the steps described below in order to prevent the variation of the opening size of the through hole (ink supply opening). (a) a step of forming a sacrifice layer on the surface of the substrate at a location where the through hole is formed, wherein the sacrifice layer is capable of being selectively etched with respect to the material of the substrate; (b) a step of forming a passivation layer having resistance to an etching process on the substrate such that the sacrifice layer is covered with the passivation layer; (c) a step of forming an etching mask layer on the back surface of the substrate, the etching mask layer having an opening corresponding to the sacrifice layer; (d) a step of etching the substrate by means of a crystal axis anisotropic etching process until the sacrifice layer is exposed via the opening; (e) a step of removing the sacrifice layer by etching the sacrifice layer from the part which has been exposed in the step of etching the substrate; (f) a step of partially removing the passivation layer so as to form a through hole.

U.S. Pat. No. 6,107,209 discloses an anisotropic etching for Si material (Si substrate) having <100> crystal plane orientation. This Si anisotropic etching is characterized in that the Si material is heated beforehand, and then, etched, so as to form a processed section having "< >" shape.

U.S. Pat. No. 6,805,432 discloses a method of manufacturing an ink jet recording head in which a dry etching is performed by utilizing a mask provided at the back surface of a substrate, and then, a crystal axis anisotropic etching process is performed by using the same mask. The processed section having "< >" shape is also formed in accordance with this manufacturing method.

The manufacturing method for forming the processed section having "< >" shape has an advantage in that it can further downsize an element substrate of an ink jet recording head. Specifically, it is advantageous in that the width of the substrate can be reduced. A further miniaturization of a substrate described above has especially been demanded in a head having plural ink supply openings on a single substrate, such as a recording head for discharging color ink.

However, the method disclosed in U.S. Pat. No. 6,107,209 has a limitation on the distance from the bottom surface of the substrate to the bent portion of the "< >" shape. Further, the final shape varies depending upon the oxygen concentration in the silicon substrate, whereby it is difficult to achieve a stable manufacture.

On the other hand, in the method disclosed in U.S. Pat. No. 6,805,432, the mask for the wet etching is also used as the mask for the dry etching. In this method, the width of the opening of the ink supply opening is determined by the width of the opening of the mask at the back surface of the substrate and etching amount of the dry etching. Therefore, in order to reduce the width of the opening of the ink supply opening so as to form a so-called narrow supply opening, it is necessary to increase the etching amount in the dry etching. However, since it takes much time to etch by the dry etching, the problem of poor production efficiency arises.

SUMMARY OF THE INVENTION

In view of the above-mentioned circumstance, the present invention aims to provide a manufacturing method of a substrate for an ink jet head capable of stably manufacturing an ink jet head substrate with high production efficiency. Specifically, the present invention aims to manufacture a substrate for an ink jet head, which has a supply opening whose opening width is reduced than a conventional one, with high precision and in a short time.

In order to achieve the foregoing object, one example of the manufacturing method of a substrate for an ink jet head is as described below. A manufacturing method of a substrate for an ink jet head, which is one example of the present invention, including forming an ink supply opening on a silicon substrate, includes: (a) forming, at the back surface of the silicon substrate, an etching mask layer, which has an opening that is asymmetric with a center line, extending in the longitudinal direction, of an area on the surface of the silicon substrate where the ink supply opening is to be formed; (b) forming a non-through hole on the silicon substrate via the opening on the etching mask layer; and (c) forming the ink supply opening by etching the silicon substrate by a crystal anisotropic etching process.

Further features of the present invention will become apparent from the following description of exemplary embodiments with reference to the attached drawings.

DESCRIPTION OF THE EMBODIMENTS

Subsequently, an embodiment of the present invention will be explained with reference to drawings.

The feature of the manufacturing method of a substrate for an ink jet head according to the present invention is such that an anisotropic etching is performed after a non-through hole (hereinafter referred to as "guide hole") is formed by, for example, a laser processing, in a method for forming an ink supply opening by using an anisotropic etching. This will be explained in detail.

Figure 1:
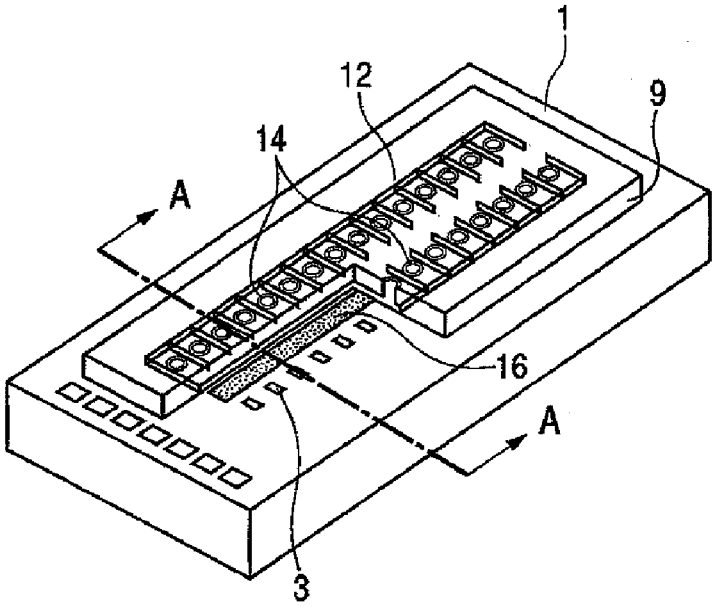
FIG. 1 is a perspective view showing a part of an ink jet recording head according to one embodiment of the present invention.

FIG. 1 shows a part of an ink jet recording head according to one embodiment of the present invention.

This ink jet recording head (liquid discharge head) has a silicon substrate 1 having energy generating elements (liquid discharge energy generating elements) 3, which generate energy used for discharging ink, arranged thereon in two rows at a predetermined pitch. A polyether amide layer (not shown) that is an adhesive layer is formed on the silicon substrate 1. Further, formed on the silicon substrate 1 are a flow path side wall 9 and ink discharge ports (liquid discharge ports) 14 opening above the energy generating elements 3, which are made of a covering photosensitive resin constituting flow path forming member 12. The flow path forming member 12 forms an upper portion of the ink flow path communicating with each ink discharge port 14 from the ink supply opening 16. The ink supply opening (liquid supply opening) 16 formed by an anisotropic etching of silicon is open between two rows of the ink discharge energy generating elements 3. This ink jet recording head discharges ink liquid droplets from the ink discharge ports 14 by adding energy, generated by the energy generating elements 3, to the ink (liquid) filled in the ink flow path through the ink supply opening 16, in order to adhere the ink liquid droplets to a recording medium, whereby recording is performed.

This ink jet recording head can be mounted to apparatuses such as printer, copying machine, facsimile having communication system, word processor having a printer section, or the like, and industrial recording apparatuses compositely combined with various processing devices. The use of the ink jet recording head makes it possible to perform recording onto various recorded medium such as paper, string, fiber, hides, metal, plastic, glass, wood, ceramics, or the like. It is to be noted that, in the present invention, "recording" includes not only providing an image having a meaning, such as characters or diagrams, onto the recorded medium, but also providing an image having no meaning, such as a pattern.

According to the manufacturing method of the present embodiment, a guide hole 20 is formed by a laser processing in a desired pattern and desired depth, and then, an anisotropic etching is performed, whereby the ink supply opening 16 having a section of "< >" shape can be easily and stably formed. The shape of "< >" means the shape in which the width of the ink supply opening 16 in the widthwise direction gradually extends from the opening at the back surface of the substrate 1 of the ink supply opening 16 to the predetermined depth of the substrate 1, and gradually narrows toward the surface of the substrate 1 with the predetermined depth position defined as the maximum width (apex) of the section.

Figure 2:
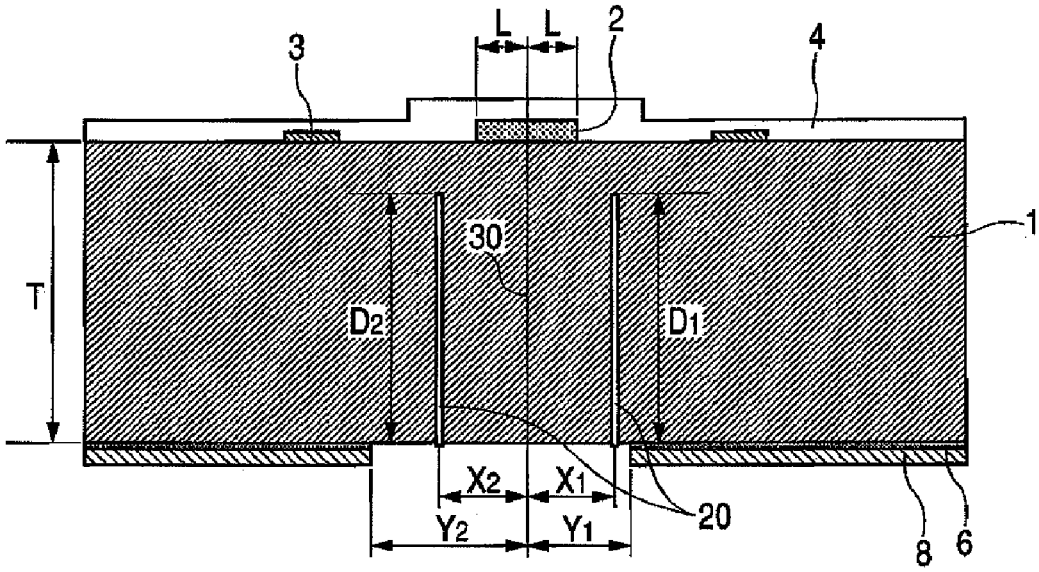
FIG. 2 is a sectional view of a substrate for an ink jet head to which the manufacturing method according to one embodiment of the present invention is applied.

FIG. 2 shows a sectional view of the substrate for the ink jet head to which the manufacturing method according to the present embodiment is applied. FIG. 2 shows a section cut along A-A line in FIG. 1. In FIG. 2, numeral 2 denotes a sacrifice layer, 4 denotes an etching stop layer (passivation layer), 1 denotes a silicon substrate, 8 denotes a back surface mask for the anisotropic etching, and 20 denotes a guide hole. The sacrifice layer 2 is provided at the area on the surface of the silicon substrate after the etching where the ink supply opening is to be formed. The sacrifice layer 2 is suitably used for precisely defining the area where the ink supply opening is to be formed, but it is not essential in the present invention. The etching stop layer (passivation layer) 4 is made of a material having resistance to the material used for the anisotropic etching. The etching stop layer 4 functions as a partition wall when elements or components are formed on the surface of the silicon substrate. The sacrifice layer 2 and etching stop layer 4 may be formed on the silicon substrate at the stage before the etching is performed, in the event that each of them is used singly or in combination. The period or order of the formation is optional at the stage before the etching, and they may be formed by any known method. In the present embodiment, at least two guide holes 20 are formed in the widthwise direction of the ink supply opening 16 at the area of the ink jet head substrate where the ink supply opening 16 is to be formed. Further, the guide holes 20 are formed in at least two rows along the longitudinal direction (coinciding with the longitudinal direction of the sacrifice layer 2, if there is the sacrifice layer 2) at the area of the ink jet head substrate where the ink supply opening 16 is to be formed (see FIG. 6). In the disclosed embodiment, the guide holes 20 are formed in two rows.

FIG. 3 schematically shows the etching process when the anisotropic etching is performed to the silicon substrate having the guide holes formed thereon as shown in FIG. 2.

Figure 3A:
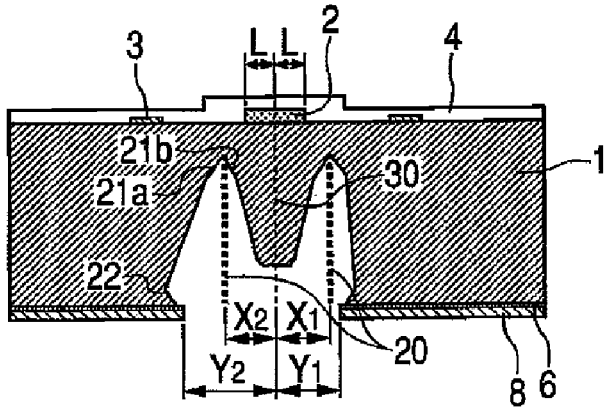
FIGS. 3A, 3B, 3C and 3D are views showing a manufacturing method of a substrate for an ink jet head according to one embodiment of the present invention.

Firstly, <111> surfaces 21*a* and 21*b* are formed in such a manner that the width is decreased toward the surface of the substrate 1 from the leading end of each of the guide holes 20 at the back surface of the substrate 1, as well as the etching is progressed in the direction (left-right direction in the figure) perpendicular to the thickness direction of the substrate 1 from the inside of the guide holes 20. Further, at the opening at the back surface of the substrate 1, <111> surface 22 is formed in such a manner that the width is increased toward the surface of the substrate 1. (FIG. 3A)

Figure 3B:
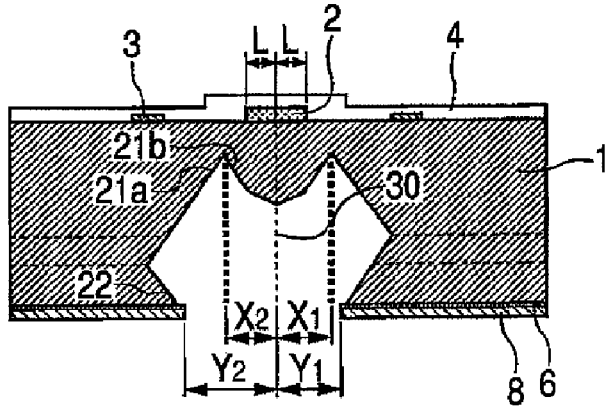

As the etching is further progressed, each of the <111> surfaces 21*b* formed from each of the guide holes 20 is brought into contact with each other between two guide holes 20, and the etching is progressed in the direction toward the surface of the substrate 1 from the apex portion formed by these <111> surfaces 21*b*. Further, the <111> surface 21*a* at the outer side of two guide holes 20 and the <111> surface 22 extending from the opening at the back surface of the substrate 1 cross each other, whereby the etching in the direction perpendicular to the thickness direction of the substrate 1 is not apparently progressed (FIG. 3B).

Figure 3C:
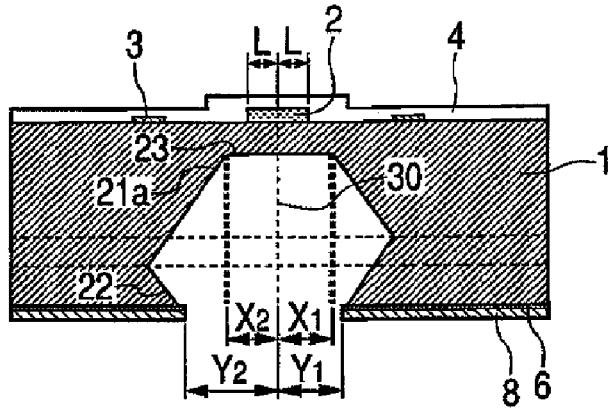
Figure 3D:
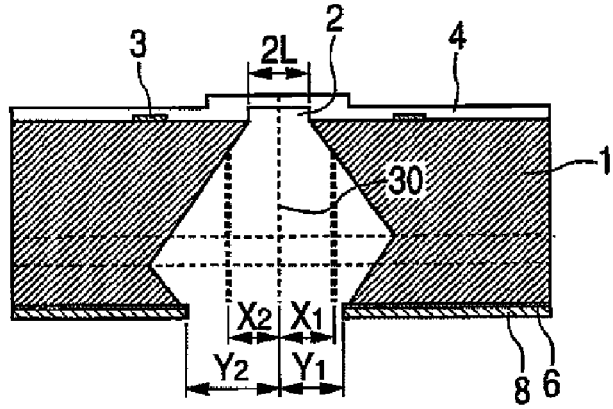

As the etching is further progressed, a <100> surface 23 is formed between two guide holes 20 (FIG. 3C). This <100> surface 23 directs toward the surface of the silicon substrate 1 with the progression of the etching to thereby finally reach the sacrifice layer 2, whereby the anisotropic etching is completed (FIG. 3D).

In the method of forming the ink supply opening 16 as described above, the position where the <111> surface 21*a* formed so as to narrow toward the surface of the substrate 1 is formed is determined depending upon the position of the guide hole 20. Further, the position where the <111> surface 22 formed from the opening at the back surface of the substrate 1 is determined depending upon the opening position of the back surface mask 8 arranged on the back surface of the substrate 1.

Referring again to FIG. 2, the distance from the center of the sacrifice layer 2 to the side edge of the sacrifice layer 2 is represented by L, and the thickness of the silicon substrate is represented by T. A center line 30 extends in the widthwise direction of said substrate toward a back surface of said substrate from a center of the area of the substrate surface where the ink supply opening is to be formed. The distance from the center of the sacrifice layer 2 to each center of the guide holes 20 is represented by X1, X2, the depth of each guide hole 20 is represented by D1, D2, and the distance from the center of the sacrifice layer 2 to the edge of the opening of the back surface mask 8 is represented by Y1, Y2. In the example using the sacrifice layer 2, the sacrifice layer 2 is formed at the area of the surface of the silicon substrate where the ink supply opening is to be formed (the area where the ink supply opening is to be formed), so that the center and edge portion of the sacrifice layer 2 and the center and edge portion of the area where the ink supply opening is to be formed coincide with each other. It might happen that an ink supply opening opened at the surface is larger than the area where the ink supply opening and the sacrifice layer are formed. It is considered that this phenomenon is caused by overetching and so on. However, this phenomenon rarely influences on a supply performance.

In order to expose the sacrifice layer 2 by performing the anisotropic etching from the back surface of the substrate 1 in the progress of the etching described above, it is preferable that the depths D1 and D2 of the guide holes 20 are within the range described below.

$$T-(X1-L)\times\tan 54.7^\circ \geqq D1 \geqq T-X1\times\tan 54.7^\circ \quad \text{Equation (1)}$$

$$T-(X2-L)\times\tan 54.7^\circ \geqq D2 \geqq T-X2\times\tan 54.7^\circ \quad \text{Equation (2)}$$

In order to form the ink supply opening 16 having the shape of "< >" described above, it is preferable that the distances Y1 and Y2 (Y1<Y2) from the center of the sacrifice layer 2 to the opening edges of the back surface mask 8 satisfy the equation described below.

$$(T/\tan 54.7^\circ)+L>Y1>X1 \quad \text{Equation (3)}$$

$$(T/\tan 54.7^\circ)+L>Y2>X2 \quad \text{Equation (4)}$$

On the other hand, when the distances Y1 and Y2 (Y1<Y2) from the center of the sacrifice layer 2 to the opening edge of the back surface mask 8 are greater than (T/tan 54.7°)+L, the ink supply opening having a <111> surface, which narrows toward the surface of the silicon substrate from the back surface thereof, is formed.

The manufacturing method of the ink jet head substrate according to the present embodiment includes appropriately changing the depth of the guide hole 20 and the distance from the center of the sacrifice layer 2 to the opening edge of the back surface mask 8 as described above. This makes it possible to form the ink supply opening 16 having the section of "< >" shape in which the depth of the apex from the back surface of the substrate 1 is different from each other at both walls opposite to each other in the widthwise direction of the ink supply opening 16.

Figure 4A:
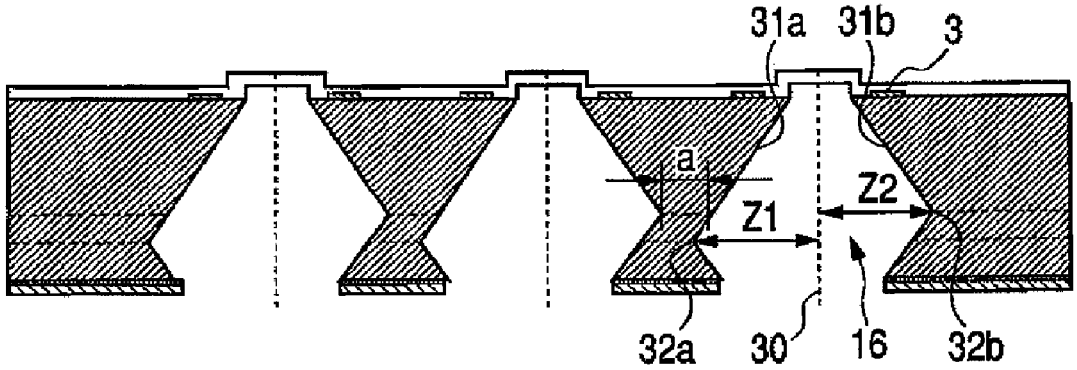
FIGS. 4A, 4B and 4C are views showing a section of the various ink jet head substrates having plural ink supply openings formed thereon.

FIG. 4A is a sectional view of a substrate for an ink jet head that is manufactured by the manufacturing method according to the present embodiment and provided with plural ink supply openings 16. In other words, "< >" shape is depicted as follows. The ink supply opening 16 is provided with wall surfaces 31*a* and 31*b* opposed to each other in a width direction of the substrate. Distances $Z_1$ and $Z_2$ between the wall surfaces and the center line 30 become large to the depth positions of apexes 32*a* and 32*b* toward the surface from the back surface of substrate. The distances $Z_1$ and $Z_2$ become greatest at the apexes 32*a* and 32*b* respectively, and become small toward the surface from the depth positions of the apexes 32*a* and 32*b*. The apexes 32*a* and 32*b* are different from each other in position in a direction from the substrate surface toward the back surface.

Figure 4B:
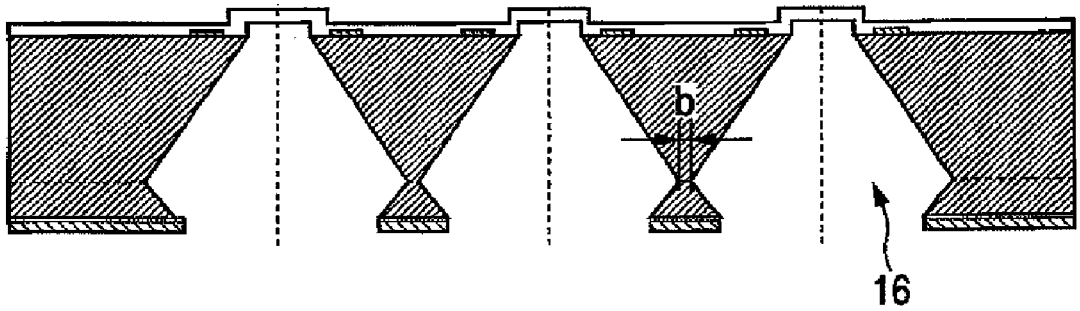
Figure 4C:
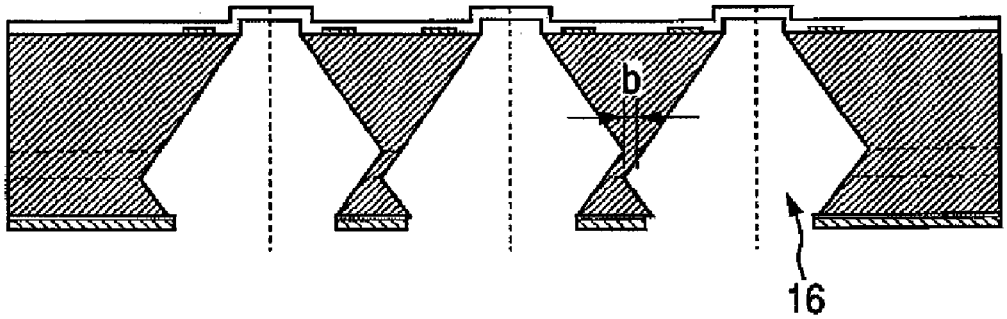

On the other hand, FIG. 4B is a sectional view of a substrate for an ink jet head that is provided with plural ink supply openings 16 having the section of "< >" shape in which the depths of the apex from the back surface of the substrate 1 are the same. As apparent from the comparison between FIG. 4A and FIG. 4B, the minimum size a between the ink supply openings 16 in the configuration shown in FIG. 4A is greater than the minimum size b between the ink supply openings 16 in the configuration shown in FIG. 4B. Therefore, the configuration shown in FIG. 4A can increase the strength of the substrate 1, compared to the configuration shown in FIG. 4B. Alternatively, in the configuration shown in FIG. 4C in which plural ink supply openings 16 are arranged, each ink supply opening having the section of "< >" shape in which the depths of the apex from the back surface of the substrate 1 are different from each other, the minimum size between the ink supply openings 16 may be the minimum size b that is the same as in the configuration shown in FIG. 4B. In this case, the arrangement pitch of the ink supply openings 16 can be more reduced than in the configuration shown in FIG. 4A, resulting in that the substrate for the ink jet head can be downsized.

Subsequently, a manufacturing method of an ink jet recording head to which the above-mentioned manufacturing method of a substrate for an ink jet head will be explained with reference to FIGS. 5A to 5H. The present invention is not limited to the embodiment, and the invention is applicable to all other techniques that should be included in the scope of the invention described in the claims.

Each of FIGS. 5A to 5H shows a section cut along a line A-A in FIG. 1.

Figure 5A:
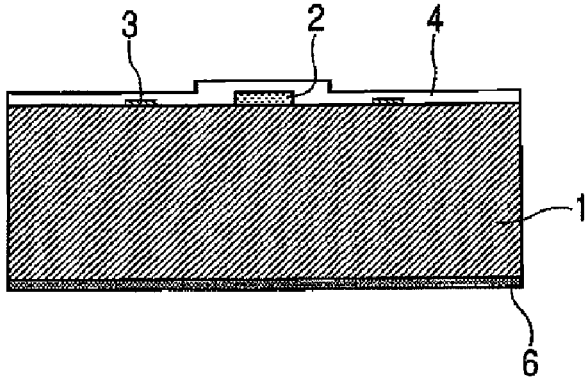
FIGS. 5A, 5B, 5C, 5D, 5E, 5F, 5G and 5H are views showing a manufacturing method of an ink jet recording head to which the manufacturing method of a substrate for an ink jet head shown in FIGS. 3A, 3B, 3C and 3D is applied.

Plural ink discharge energy generating elements 3 (energy generating elements) such as a heat generation resistive material or the like are arranged on the surface of the substrate 1 shown in FIG. 5A. The whole back surface of the substrate 1 is covered with a $SiO_2$ film 6. The sacrifice layer 2 that is dissolved upon forming the ink supply opening 16 by alkaline solution is formed on the surface of the substrate 1. A wiring of the energy generating elements 3 or a semiconductor element used for drive is not illustrated. The sacrifice layer 2 is made of a material that can be etched with alkaline solution, e.g., the sacrifice layer 2 is made of polysilicon, aluminum having a fast etching speed, aluminum silicon, aluminum copper, aluminum silicon copper or the like. The material for the sacrifice layer 2 is not limited to the above-mentioned materials. A material having a faster etching speed with the alkaline solution than silicon can suitably be selected. It is necessary that the etching by means of alkaline solution does not progress in the etching stop layer 4 after the sacrifice layer 2 is exposed during the anisotropic etching of the substrate 1. The etching stop layer 4 is preferably made of, for example, silicon oxide positioned at the back side of the heater 3 to be used as a heat accumulation layer, silicon nitride positioned above the ink discharge energy generating elements 3 to function as a protective film, or the like.

Figure 5B:
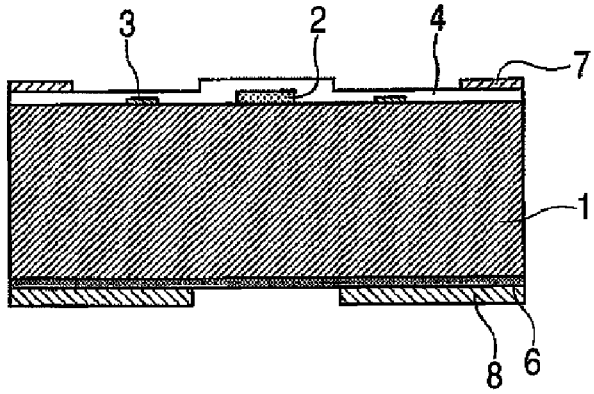

Next, as shown in FIG. 5B, polyether amide resins 7, 8 are applied onto the surface and back surface of the substrate 1, and then, they are hardened by a baking process. In order to pattern the polyether amide resin 7, a positive resist (not shown) is applied onto the surface of the substrate 1 by a spin coating process or the like, exposed, and developed to pattern the polyether amide resin 7 by a dry etching or the like, and then, the positive resist is removed. Similarly, in order to pattern the polyether amide resin 8, a positive resist (not shown) is applied onto the back surface of the substrate 1 by a spin coating process or the like, exposed, and developed to pattern the polyether amide resin 8 by a dry etching or the like, and then, the positive resist is removed. Thus, the back surface mask 8 is formed on the back surface of the substrate 1.

Figure 5C:
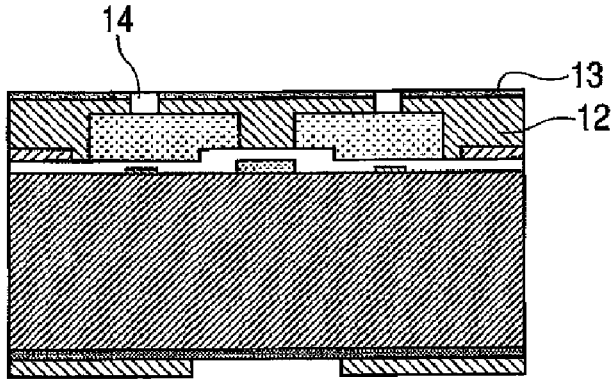

Next, as shown in FIG. 5C, a positive resist 10 which is a mold material to form the ink flow path is patterned on the surface of the substrate 1.

Figure 5D:
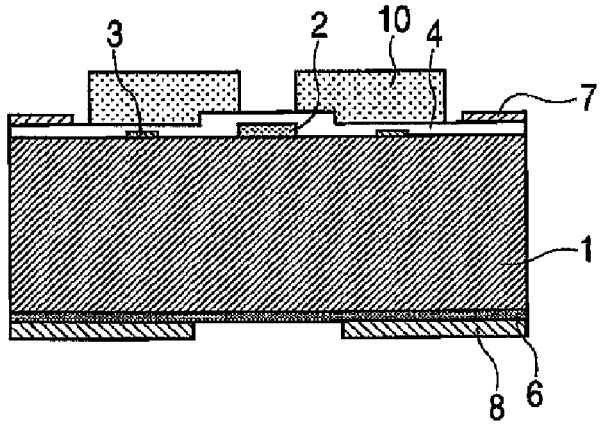

Next, as shown in FIG. 5D, a coating photosensitive resin 12 to form a nozzle forming member is formed on to the positive resist 10 by a spin coating process or the like. Further, a water repellency agent 13 is formed onto the covering photosensitive resin 12 in such a manner that a dry film is laminated. Then, the covering photosensitive resin 12 is exposed to an ultraviolet ray, DeepUV ray, or the like, developed, and patterned to form the ink discharge port 14 on the covering photosensitive resin 12.

Figure 5E:
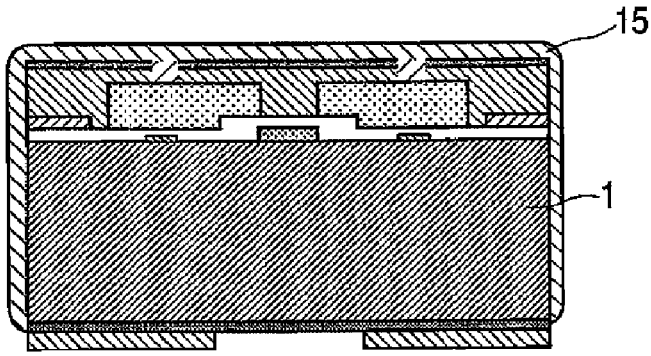

Next, as shown in FIG. 5E, the surface of the substrate 1 where the positive resist 10 and the covering photosensitive resin 12 are formed and the side face of the substrate 1 are covered with a protecting material 15 with a spin coating process.

Figure 5F:
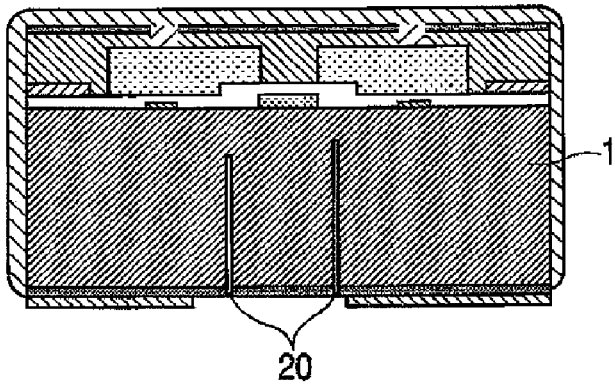

Next, as shown in FIG. 5F, the guide hole 20 is formed from the back surface of the substrate 1 toward the surface of the substrate 1 with a laser processing. In this case, the guide hole 20 is formed in two rows along the longitudinal direction of the sacrifice layer 2. Laser beam having third harmonic of YAG laser (THG: wavelength of 355 nm) is used to form the guide hole 20, wherein the power and frequency of the laser beam are set to appropriate values. In this embodiment, the diameter of the guide hole 20 is set to approximately ϕ40 μm. It is desirable that the diameter of the guide hole 20 is approximately ϕ5 to 100 μm. When the diameter is too small, the etching solution used in the later-performed anisotropic etching is difficult to enter into the guide hole 20. On the other hand, when the diameter is too large, it takes much time to form the guide hole 20 having a desired depth. In the case where the diameter of the guide hole 20 is increased, it is necessary to set, according to the increased diameter, the processing pitch in order that the adjacent guide holes 20 are not overlapped with each other.

Figure 6:
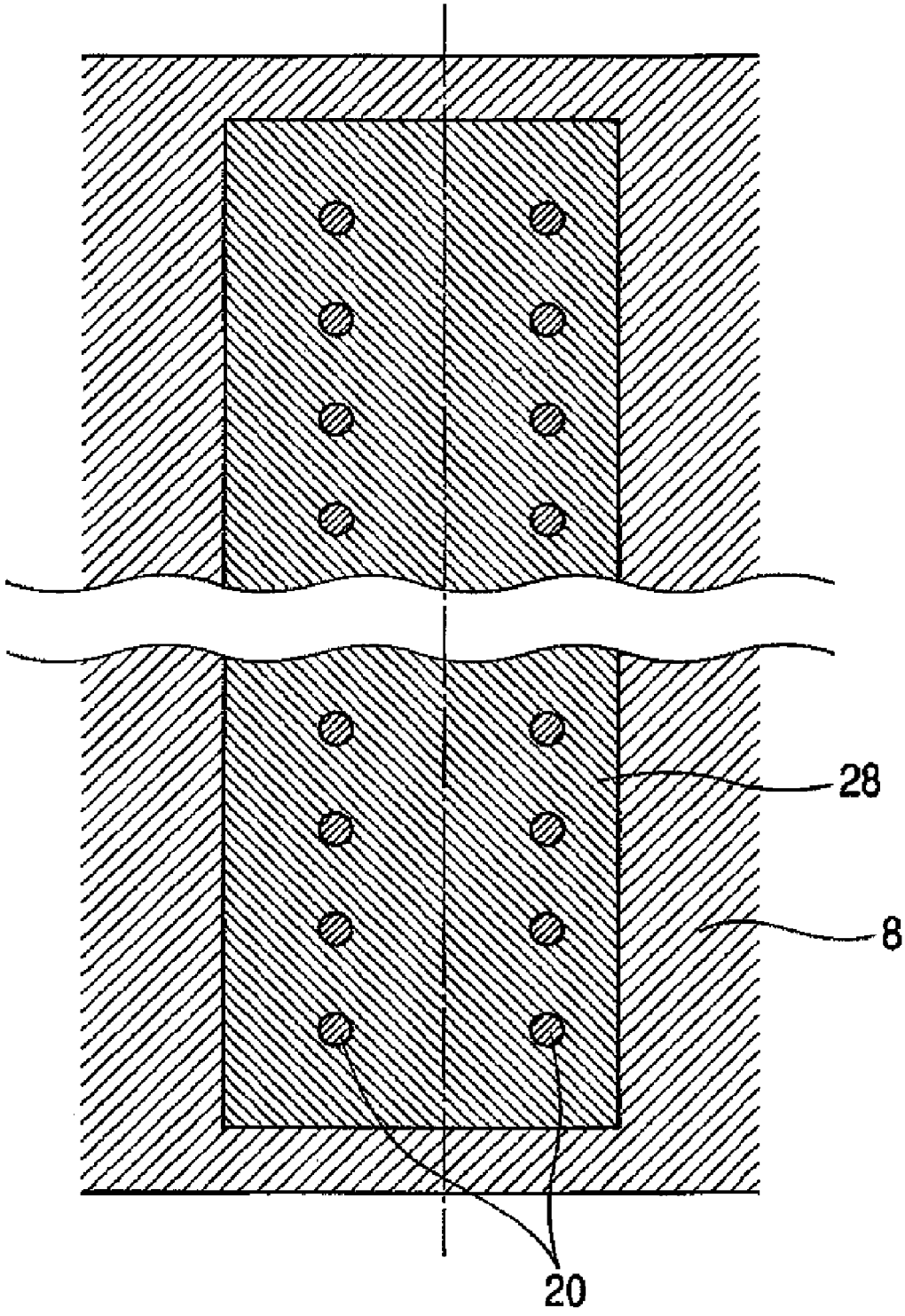
FIG. 6 is a plan view showing a back surface of the substrate where a guide hole is formed at the process shown in FIG. 5F.

FIG. 6 shows a plan view of the back surface of the substrate 1 when the guide hole 20 is formed at the process shown in FIG. 5F. An opening 28 of the polyether amide resin (back surface mask) 8 is formed at the position corresponding to the sacrifice layer 2 formed on the surface of the substrate 1. This opening 28 is formed at the step shown in FIG. 5B, and functions as a mask for the anisotropic etching performed to the substrate 1. In the present embodiment, the opening size of the opening 28 in the widthwise direction is 450 μm (Y1=150 μm, Y2=300 μm). Plural guide holes 20 are formed at the area in the opening 28 with a pitch of 250 μm in the widthwise direction of the opening 28 and with a pitch of 150 μm in its longitudinal direction.

The thickness of the substrate 1 is 600 μm, and the width of the sacrifice layer 2 in the widthwise direction is 150 μm in this embodiment. The distance X1 from the center of the sacrifice layer 2 in the widthwise direction to the center of the guide hole 20 is 100 μm, the distance X2 is 150 μm. The irradiation pulse of the laser beam is set such that the depth of the guide hole 20 is adapted to the equations (1) and (2) on the basis of these sizes, whereby the guide hole 20 is laser-processed. As a result, the depth D1 of the guide hole 20 is within the range of 470 to 500 μm, and D2 is within the range of 400 to 430 μm, according to the measurement of the depth by the observation of the section of the substrate 1.

Although the guide hole 20 is processed with the use of the laser beam having third harmonic of YAG laser (THG: wavelength of 355 nm), the laser beam that can be used for processing is not limited thereto. Laser beams having wavelength capable of forming a hole on silicon that is the material of the substrate 1 can be used. For example, the laser beam having second harmonic of YAG laser (SHG: wavelength of 532 nm) has high absorptivity to silicon, similar to the THG, so that the guide hole 20 may be formed by using this laser beam. Of course, the guide hole may be formed by processes other than the process using the laser beam.

Figure 5G:
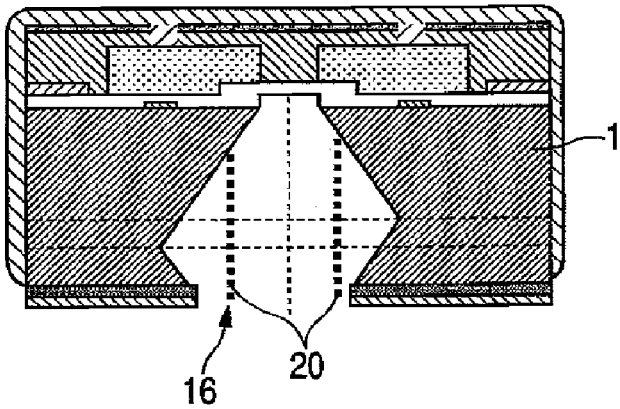

Next, as shown in FIG. 5G, the $SiO_2$ film 6 in the opening 28 (see FIG. 6) at the back surface of the substrate 1 is removed to expose the Si surface, which is the surface where the anisotropic etching of the substrate 1 is started, and thereafter, the ink supply opening 16 is formed. Specifically, the $SiO_2$ film 6 at the back surface of the substrate 1 in the opening 28 is firstly removed with the polyether amide resin 8 used as the back surface mask. Thereafter, TMAH is used as anisotropic etching solution, and the etching is performed from the back surface of the substrate 1 to form the ink supply opening 16 reaching the sacrifice layer 2. In this etching, the etching is progressed according to the process explained with reference to FIGS. 3A to 3D, whereby the <111> surface formed at an angle of 54.7° to the back surface of the substrate 1 at the leading end of the guide hole 20 reaches the sacrifice layer 2. The sacrifice layer 2 is isotropically etched by the etching solution, whereby the ink supply opening 16 is formed so as to have its upper end formed into the shape of the sacrifice layer 2. Further, the section of the ink supply opening 16 in the direction of A-A line in FIG. 1 is formed into the "< >" shape by the <111> surface.

Figure 5H:
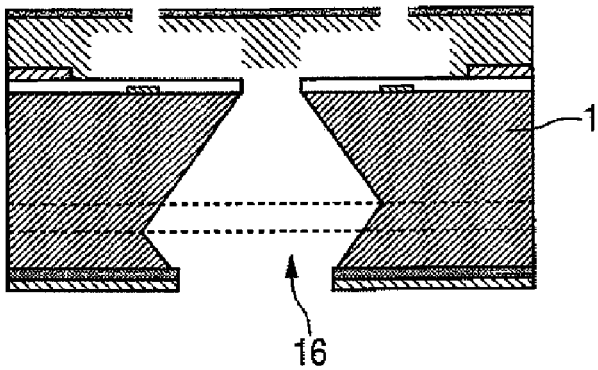

Finally, as shown in FIG. 5H, the portion of the etching stop layer 4 that covers the opening of the ink supply opening 16 is removed by dry etching. Then, the polyether amide resin 8 and protective material 15 are removed. Moreover, the positive resist 10 is eluted from the ink discharge port 14 and ink supply opening 16, thereby forming the ink flow path and bubble generating chamber.

According to the processes described above, the substrate 1 having the nozzle portion formed thereon is completed. Thereafter, the substrate 1 is cut and separated into chips by a dicing saw or the like, and electric wiring is bonded in order to drive the ink discharge energy generating elements 3. Furthermore, a tank member is connected in order to supply the ink, thereby completing the ink jet recording head.

As a result of the evaluation of an image formed by discharging alkali ink having pH 10 with the use of the thus manufactured ink jet recording head, a satisfactory recording image could be obtained. The ink jet recording head was dipped into the aforesaid ink of 60° C. for three months, and then, the ink was discharged to form an image. As a result of the evaluation of this image, a satisfactory recording image could be obtained.

In the present embodiment, the substrate for an ink jet head is manufactured by using the substrate 1 having a thickness of 600 μm. However, the manufacturing method of a substrate for an ink jet head according to the present invention is also applicable to a substrate thinner or thicker than the substrate 1. In this case, the depth of the guide hole 20 and the size of the opening 28 are appropriately changed in order to satisfy the equations (1) to (4).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-061403, filed Mar. 7, 2006 which is hereby incorporated by reference herein in its entirety.

What is claimed is:

1. A manufacturing method of a substrate for an ink jet head including forming an ink supply opening to a silicon substrate, comprising the steps of:

(a) providing, at a back surface of the silicon substrate, an etching mask layer, which has an opening that is asymmetric with a center in a widthwise direction of an area on a to surface of the silicon substrate where the ink supply opening is to be formed;

(b) forming recesses in the silicon substrate within the opening of the etching mask layer in at least two rows in a longitudinal direction of the opening, said recesses being arranged to be substantially symmetric with respect to the center; and (c) forming the ink supply opening by performing a crystal anisotropic etching to the silicon substrate from the opening of the etching mask layer.

2. The manufacturing method of a substrate for an ink jet head according to claim 1, wherein the recesses are formed so as to satisfy the relationship of $$T-(X1-L)\times\tan 54.7^\circ \geqq D1 \geqq T-X1\times\tan 54.7^\circ$$

$$T-(X2-L)\times\tan 54.7^\circ \geqq D2 \geqq T-X2\times\tan 54.7^\circ$$

wherein the distance from a center line of the area on the top surface of the silicon substrate where the ink supply opening is to be formed to an edge portion of the area where the ink supply opening is to be formed is defined as L, the thickness of the silicon substrate is defined as T, the distance from the center line to the center of the recess at one row is defined as X1, the distance from the center line to the center of the recess at the other row is defined as X2, the depth of the recess at one row is defined as D1, and the depth of the recess at the other row is defined as D2.

3. The manufacturing method of a substrate for an ink jet head according to claim 2, wherein the step of (b) includes forming the etching mask layer so as to satisfy the relationship of $$(T/\tan 54.7^\circ)+L>Y1>X1$$

$$(T/\tan 54.7^\circ)+L>Y2>X2$$

wherein the distance from the center line to the edge of the formed opening at the side where the recess at one row is present is defined as Y1, and the distance from the center line to the edge of the formed opening at the side where the recess at the other row is present is defined as Y2.

4. The manufacturing method of a substrate for an ink jet head according to claim 1, wherein the step of (b) includes forming the recesses by using fundamental harmonic, second harmonic, or third harmonic, of YAG laser.

5. The manufacturing method of a substrate for an ink jet head according to claim 1, comprising performing the crystal anisotropic etching to the silicon substrate by using TMAH solution.

6. The manufacturing method of a substrate for an ink jet head according to claim 1, wherein the crystal orientation surface of the front surface and back surface of the silicon substrate is (100).

7. The manufacturing method of a substrate for an ink jet head according to claim 1, wherein, at least at the stage before the step of (c), a passivation layer having resistance to etching is formed on the surface of the silicon substrate, and a part of the passivation layer is removed so as to open the ink supply opening at the surface of the silicon substrate.

8. A manufacturing method of an ink jet head including a substrate provided with an element for generating energy used for discharging ink and an ink supply opening for supplying ink to the element, the method comprising the steps of:

(a) providing, at a back surface of the silicon substrate, an etching mask layer, which has an opening that is asymmetric with a center in a widthwise direction of an area on a top surface of the silicon substrate where the ink supply opening is to be formed;

(b) forming recesses in the silicon substrate within the opening of the etching mask layer in at least two rows in a longitudinal direction of the opening, said recesses being arranged to be substantially symmetric with respect to the center;

(c) forming the ink supply opening by performing a crystal anisotropic etching to the silicon substrate from the opening of the etching mask layer; and (d) providing a member including discharge port for discharging ink on the substrate.

9. The manufacturing method of an ink jet head according to claim 8, wherein the recesses are formed so as to satisfy the relationship of $$T-(X1-L)\times\tan 54.7^\circ \geqq D1 \geqq T-X1\times\tan 54.7^\circ$$

$$T-(X2-L)\times\tan 54.7^\circ \geqq D2 \geqq T-X2\times\tan 54.7^\circ$$

wherein the distance from a center line of the area on the top surface of the silicon substrate where the ink supply opening is to be formed to an edge portion of the area where the ink supply opening is to be formed is defined as L, the thickness of the silicon substrate is defined as T, the distance from the center line to the center of the recess at one row is defined as X1, the distance from the center line to the center of the recess at the other row is defined as X2, the depth of the recess at one row is defined as D1, and the depth of the recess at the other row is defined as D2.

10. The manufacturing method of an ink jet head according to claim 8, wherein the crystal orientation surface of the front surface and back surface of the silicon substrate is (100).

11. A manufacturing method of a substrate for an ink jet head including forming an ink supply opening on a silicon substrate, comprising the steps of:

preparing a silicon substrate, wherein an etching mask layer having an opening, which is asymmetric with a center in a widthwise direction of an area on a top surface of the silicon substrate where an ink supply opening is to be formed, is provided on a back surface of the silicon substrate, and recesses are provided in the silicon substrate within the opening of the etching mask layer in at least two rows in a longitudinal direction of the opening, said recesses being arranged to be substantially symmetric with respect to the center; and etching the silicon substrate by a crystal anisotropic etching to form the ink supply opening.

* * * * *